US005939154A

United States Patent [19]

Gonzalez

[11] Patent Number: 5,939,154

[45] Date of Patent: Aug. 17, 1999

[54] SPACE SAVING CHRISTMAS TREE KIT

[76] Inventor: Jose T. Gonzalez, 1855 N. Joyce Ave., Rialto, Calif. 92376

[21] Appl. No.: 09/031,510

[22] Filed: Feb. 26, 1998

[51] Int. Cl.[6] ..... A47G 33/06

[52] U.S. Cl. ..... 428/8; 428/20

[58] Field of Search ..... 428/20, 18, 8; 362/123; 211/205

*Primary Examiner*—Alexander Thomas

[57] ABSTRACT

A new space saving Christmas tree kit for mounting to a surface, such as a window. The inventive device includes an elongate trunk member and a plurality of elongate branch members shaped and formed to resemble branches of a pine tree. The trunk member has a plurality of spaced apart suction cups outwardly extending from the back of the trunk member mounting the trunk member to a surface. The kit also includes a star member, a plurality of ornaments, and a string of lights which are adapted to be mounted to a tree. The branch members are couplable to the trunk member so that the truck member and the branch members resemble a pine tree.

6 Claims, 2 Drawing Sheets

SPACE SAVING CHRISTMAS TREE KIT

BACKGROUND OF THE INVENTION

1. Field of the Invention

The present invention relates to Christmas tree assemblies and more particularly pertains to a new space saving Christmas tree kit for mounting to a surface, such as a window.

2. Description of the Prior Art

The use of Christmas tree assemblies is known in the prior art. More specifically, Christmas tree assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art Christmas tree assemblies include U.S. Pat. No. 5,338,585; U.S. Pat. No. 4,511,607; U.S. Pat. No. 5,307,252; U.S. Pat. No. 4,612,218; U.S. Pat. No. Des. 351,810; and U.S. Pat. No. 4,109,036.

While these devices fulfill their respective, particular objectives and requirements, the aforementioned patents do not disclose a new space saving Christmas tree kit. The inventive device includes an elongate trunk member and a plurality of elongate branch members shaped and formed to resemble branches of a pine tree. The trunk member has a plurality of spaced apart suction cups outwardly extending from the back of the trunk member mounting the trunk member to a surface. The kit also includes a star member, a plurality of ornaments, and a string of lights which are adapted to be mounted to a tree. The branch members are couplable to the trunk member so that the truck member and the branch members resemble a pine tree.

In these respects, the space saving Christmas tree kit according to the present invention substantially departs from the conventional concepts and designs of the prior art, and in so doing provides an apparatus primarily developed for the purpose of mounting to a surface, such as a window.

SUMMARY OF THE INVENTION

In view of the foregoing disadvantages inherent in the known types of Christmas tree assemblies now present in the prior art, the present invention provides a new space saving Christmas tree kit construction wherein the same can be utilized for mounting to a surface, such as a window.

The general purpose of the present invention, which will be described subsequently in greater detail, is to provide a new space saving Christmas tree kit apparatus and method which has many of the advantages of the Christmas tree assemblies mentioned heretofore and many novel features that result in a new space saving Christmas tree kit which is not anticipated, rendered obvious, suggested, or even implied by any of the prior art Christmas tree assemblies, either alone or in any combination thereof.

To attain this, the present invention generally comprises an elongate trunk member and a plurality of elongate branch members shaped and formed to resemble branches of a pine tree. The trunk member has a plurality of spaced apart suction cups outwardly extending from the back of the trunk member mounting the trunk member to a surface. The kit also includes a star member, a plurality of ornaments, and a string of lights which are adapted to be mounted to a tree. The branch members are couplable to the trunk member so that the truck member and the branch members resemble a pine tree.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new space saving Christmas tree kit apparatus and method which has many of the advantages of the Christmas tree assemblies mentioned heretofore and many novel features that result in a new space saving Christmas tree kit which is not anticipated, rendered obvious, suggested, or even implied by any of the prior art Christmas tree assemblies, either alone or in any combination thereof.

It is another object of the present invention to provide a new space saving Christmas tree kit which may be easily and efficiently manufactured and marketed.

It is a further object of the present invention to provide a new space saving Christmas tree kit which is of a durable and reliable construction.

An even further object of the present invention is to provide a new space saving Christmas tree kit which is susceptible of a low cost of manufacture with regard to both materials and labor, and which accordingly is then susceptible of low prices of sale to the consuming public, thereby making such space saving Christmas tree kit economically available to the buying public.

Still yet another object of the present invention is to provide a new space saving Christmas tree kit which provides in the apparatuses and methods of the prior art some of the advantages thereof, while simultaneously overcoming some of the disadvantages normally associated therewith.

Still another object of the present invention is to provide a new space saving Christmas tree kit for mounting to a surface, such as a window.

Yet another object of the present invention is to provide a new space saving Christmas tree kit which includes an elongate trunk member and a plurality of elongate branch members shaped and formed to resemble branches of a pine tree. The trunk member has a plurality of spaced apart suction cups outwardly extending from the back of the trunk member mounting the trunk member to a surface. The kit also includes a star member, a plurality of ornaments, and a string of lights which are adapted to be mounted to a tree. The branch members are couplable to the trunk member so that the truck member and the branch members resemble a pine tree.

Still yet another object of the present invention is to provide a new space saving Christmas tree kit that gives the illusion of a full size Christmas tree while taking up considerably less space than a conventional Christmas tree.

Even still another object of the present invention is to provide a new space saving Christmas tree kit that can be mounted to various surfaces, including windows, closets, walls, and even the exterior of a vehicle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
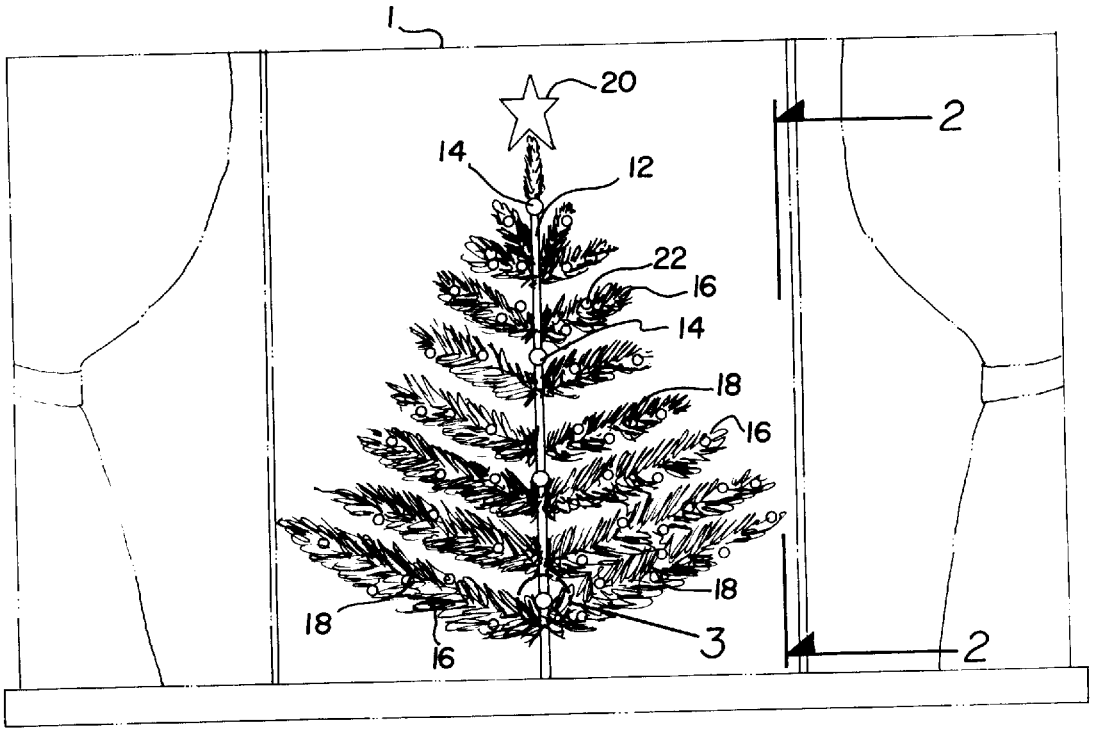
FIG. 1 is a schematic front side view of a new space saving Christmas tree kit in use according to the present invention.

With reference now to the drawings, and in particular to FIGS. 1 through 4 thereof, a new space saving Christmas tree kit embodying the principles and concepts of the present invention and generally designated by the reference numeral 10 will be described.

As best illustrated in FIGS. 1 through 4, the space saving Christmas tree kit 10 generally comprises an elongate trunk member 12 and a plurality of elongate branch members 16 shaped and formed to resemble branches of a pine tree. The trunk member 12 has a plurality of spaced apart suction cups outwardly extending from the back of the trunk member mounting the trunk member 12 to a surface 1. The kit also includes a star member 20, a plurality of ornaments 22, and a string of lights 24 which are adapted to be mounted to a tree. The branch members 16 are couplable to the trunk member 12 so that the truck member 12 and the branch members 16 resemble a pine tree.

The Christmas tree kit 10 is designed for mounting to a surface 1, preferably a vertical surface such as a window or a wall, so that a user may display a Christmas tree in a smaller and more convenient space than traditional Christmas trees.

The elongate trunk member 12 has a pair of opposite upper and lower ends, a front, a back, and a longitudinal axis extending between its ends. Ideally, the length the trunk member 12, which is defined between the ends of the trunk member 12, is less than about 24 inches. Preferably, the trunk member 12 has a plurality of spaced apart suction cups 14 outwardly extended from the back of the trunk member 12 for suctionally mounting the trunk member 12 to a surface 1. Ideally, the suction cups of the trunk member 12 are generally transparent so that they are hard to see when the tree is displayed.

Figure 4:
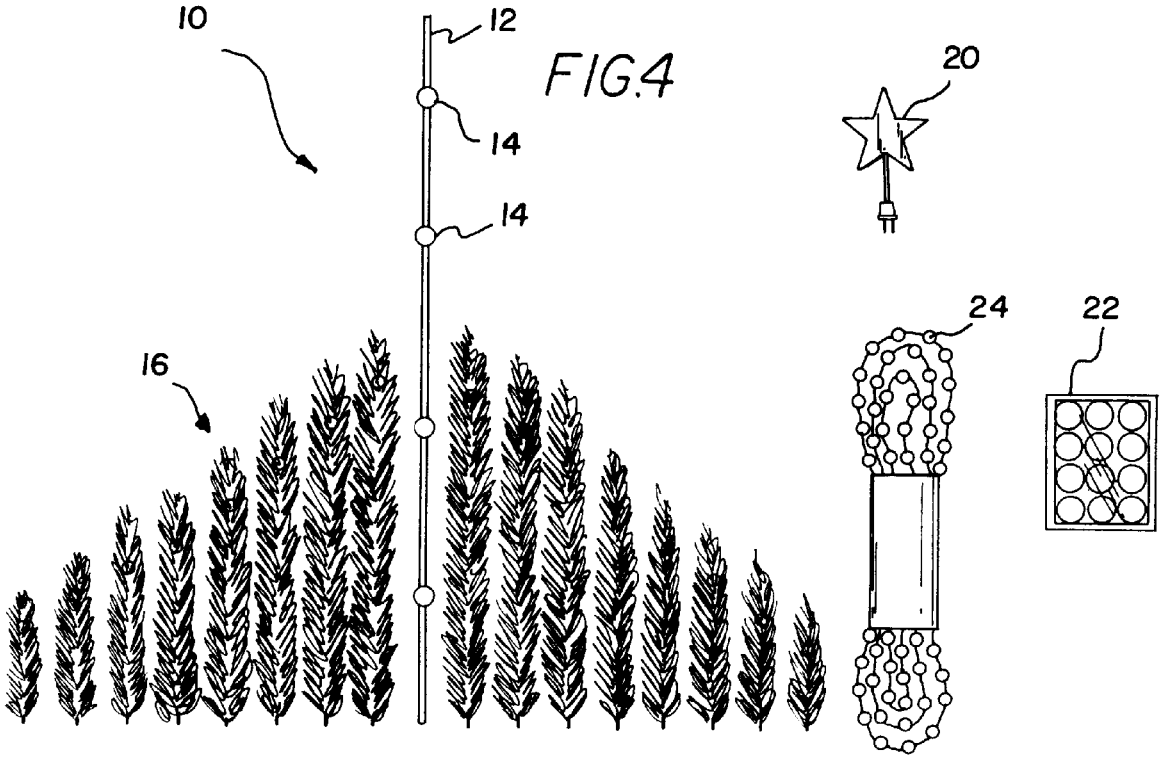
FIG. 4 is a schematic view of the elements of present invention.

The kit 10 also includes a plurality of elongate branch members 16 which are shaped and formed to resemble branches of a pine tree. Preferably, the branch members 16 are made from firm garland material having a wire core. Each branch member 16 has a pair of opposite ends, a front, a back, and a longitudinal axis. As shown in FIG. 4, the branch members 16 are dividable into separable groups, where the branch members 16 of the same group have generally equal lengths with respect to one and other.

Optionally, each the branch member 16 may also have a suction cup 18 outwardly extending from their back side. Ideally, these suction cups 18 are colored to generally resemble ornament balls. Like the suction cups of the trunk member 12, the suction cups 18 of the branch members 16 are designed for suctionally mounting the branch members 16 to a surface 1.

Figure 2:
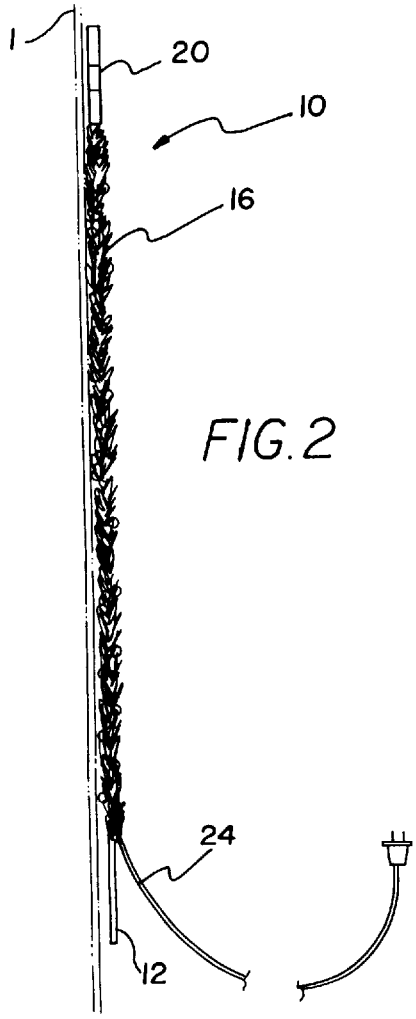
FIG. 2 is a schematic side view of the present invention in use.
Figure 3:
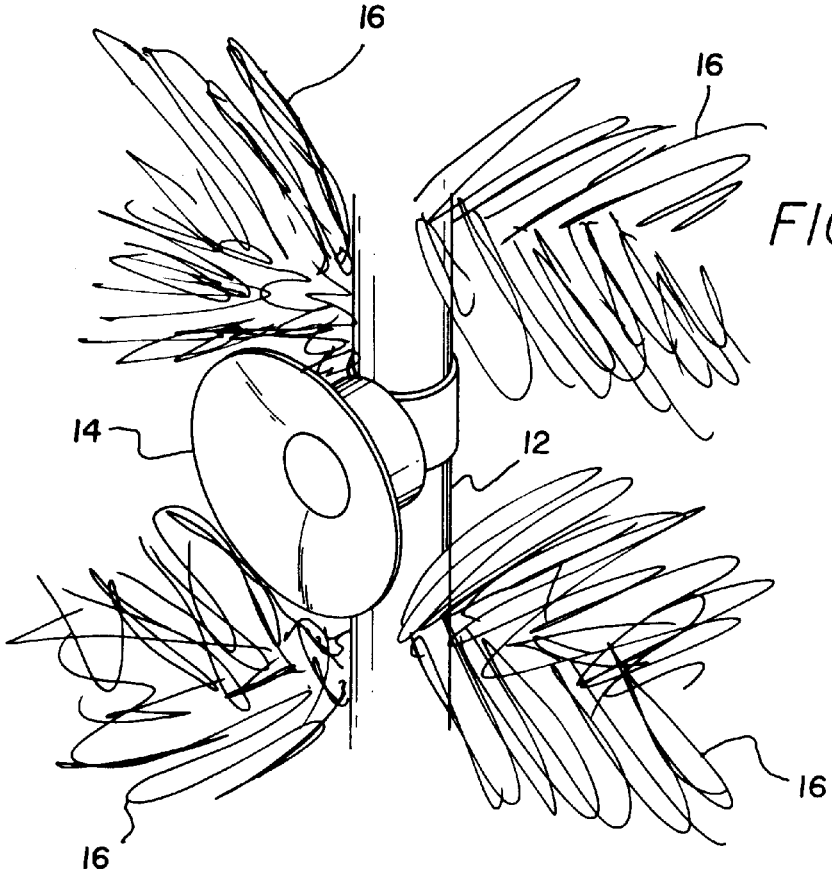
FIG. 3 is a schematic partial perspective view of the present invention taken from the circle 3 on FIG. 1.

One end of each of the branch members 16 is detachably couplable (preferably with green tape) to the trunk member 12 so that the branch members extend outwardly from the trunk member 12. The branch members 16 is arranged with respect to one another on the trunk member 12 to resemble a pine tree. Ideally, as illustrated in FIG. 2, the longitudinal axis of the branch members 16 are generally coplanar with the longitudinal axis of the trunk member 12. When assembled the trunk member 12 and the branch members 16 are then mountable to a surface by the suction cups 14,18. Ideally, the assembled tree has an overall width of about 20 inches.

As illustrated in FIG. 4, kit 10 further includes a star member 20, a plurality of ornaments 22, and a string of lights 24. The elements are all adapted to be mounted to a tree, in particular to the branch members 16 in order to decorate the assembled tree.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A Christmas tree kit for mounting to a surface, comprising:

an elongate trunk member having a pair of opposite ends, a front, a back, and a longitudinal axis being extended between said ends of said trunk member;

a plurality of elongate branch members being shaped and formed to resemble branches of a pine tree, each said branch member having a pair of opposite ends, a front, a back, and a longitudinal axis;

wherein said trunk member has a plurality of spaced apart suction cups being outwardly extended from said back of said trunk member, said suction cups of said trunk member being for suctionally mounting said trunk member to a surface;

a star member;

a plurality of ornaments;

a string of lights;

wherein said star member, said ornaments, and said string of lights being adapted to be mounted to a tree;

wherein one end of each of said branch members being couplable to said trunk member, said branch member being extended outwardly from said trunk member;

wherein said star, said ornaments, and said lights are mountable to said branch members.

2. The kit of claim 1, wherein said trunk member has a length being defined between said ends of said trunk member, wherein said length said trunk member is less than about 24 inches.

3. The kit of claim 1, wherein said suction cups of said trunk member are generally transparent.

4. The kit of claim 1, wherein each said branch member has a suction cup member being outwardly extended from said back of said branch member.

5. The kit of claim 1, wherein said longitudinal axis of said branch members are generally coplanar with said longitudinal axis of said trunk member.

6. A Christmas tree kit for mounting to a surface, comprising:

an elongate trunk member having a pair of opposite ends, a front, a back, and a longitudinal axis being extended between said ends of said trunk member, wherein said trunk member has a length being defined between said ends of said trunk member, wherein said length said trunk member is less than about 24 inches;

a plurality of elongate branch members being shaped and formed to resemble branches of a pine tree, each said branch member having a pair of opposite ends, a front, a back, and a longitudinal axis;

wherein said trunk member has a plurality of spaced apart suction cups being outwardly extended from said back of said trunk member, wherein said suction cups of said trunk member are generally transparent, said suction cups of said trunk member being for suctionally mounting said trunk member to a surface;

wherein each said branch member has a suction cup member being outwardly extended from said back of said branch member, said suction cups of said branch members being for suctionally mounting said branch members to a surface;

a star member;

a plurality of ornaments;

a string of lights;

wherein said star member, said ornaments, and said string of lights being adapted to be mounted to a tree;

wherein one end of each of said branch members being detachably couplable to said trunk member, said branch member being extended outwardly from said trunk member, wherein said longitudinal axis of said branch members are generally coplanar with said longitudinal axis of said trunk member;

wherein said star, said ornaments, and said lights are mountable to said branch members; and wherein said trunk member and said branch members are mountable to a surface by said suction cups.

* * * * *